US006732629B1

(12) United States Patent
Miller et al.

(10) Patent No.: US 6,732,629 B1
(45) Date of Patent: May 11, 2004

(54) PNEUMATIC ACTUATOR CIRCUIT

(75) Inventors: Stanley F. Miller, Orange, CA (US); Paul Smirl, Dana Point, CA (US); Flavio Tondolo, Stezzano BG (IT)

(73) Assignee: Control Components, Inc., Rancho Santa Margarita, CA (US)

( * ) Notice: Subject to any disclaimer, the term of this patent is extended or adjusted under 35 U.S.C. 154(b) by 51 days.

(21) Appl. No.: 10/298,381

(22) Filed: Nov. 18, 2002

(51) Int. Cl.[7] ..... F15B 13/16
(52) U.S. Cl. ..... 91/363 A; 91/361
(58) Field of Search ..... 91/51, 360, 362, 91/363 R, 363 A, 399, 461; 60/459

(56) References Cited

U.S. PATENT DOCUMENTS 4,757,747 A * 7/1988 Blatter et al. ..... 91/362
5,012,722 A * 5/1991 McCormick ..... 91/361
5,195,722 A * 3/1993 Bachrach et al. ..... 280/5.501
5,899,064 A * 5/1999 Cheung ..... 91/363 A
6,116,139 A * 9/2000 Yuda et al. ..... 91/51

* cited by examiner

*Primary Examiner*—Thomas E. Lazo
(74) *Attorney, Agent, or Firm*—Stetina Brunda Garred & Brucker

(57) ABSTRACT

Disclosed is a piston positioning system for positioning a piston within a cylinder of a pneumatic circuit. The system comprises a piston position indicator for sensing an actual piston position, a controller for generating an output signal in response to the piston position signal, a pneumatic valving device for regulating the flow of pneumatic fluid and a solenoid valve configured to energize the pneumatic valving device. The pneumatic valving device comprises a four-way valve, a servo valve coupled to a stepper motor, and a two-way valve. The reversible stepper motor is incrementally rotatable over a desired angle of rotation in proportion to the magnitude of the output signal for linearly translating the servo valve such that the flow of pneumatic fluid maybe manipulated into and out of first and second ends of the cylinder to control the piston position therewithin.

11 Claims, 6 Drawing Sheets

PNEUMATIC ACTUATOR CIRCUIT

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to fluid flow control and, more particularly, to a piston positioning system and method for use thereof for positioning a piston within a cylinder of a pneumatic circuit. The piston positioning system includes a pneumatic valving device for manipulating a flow of pressurized pneumatic fluid within the pneumatic circuit.

Pneumatic systems typically involve a source of compressed air to provide a working pneumatic fluid. The compressed air is typically obtained from a compressor which is usually driven by an electric motor or an internal combustion engine. The compressed air is routed through pipes to control valves which selectively direct the routing of the compressed air. The control valves may be operated by electrically initiated solenoids or by pneumatic pilots. Pneumatic systems are typically employed to move an actuator which is conventionally comprised of a piston sealed within a cylinder. The piston may have a shaft extending out of the cylinder and connected to the component to be moved. The pneumatic system moves the piston by forcing air into a first end of the cylinder while simultaneously withdrawing or exhausting air out of a second end of the cylinder in order to advance the piston along the length of the cylinder. Conversely, the pneumatic system may force air into the second end of the cylinder while simultaneously exhausting air out of the first end of the cylinder in order to retract the piston in the opposite direction. By driving the air into alternate ends of the cylinder, the piston is moved such that the shaft can be displaced in any position for doing useful work.

Pneumatic and hydraulic systems are commonly used in large scale applications such as in power plants and refineries for controlling system components such as a working valve. In such applications, it may be desirable to quickly and repeatedly position the working valve to within thousandths of an inch. Such large scale applications involve extreme pressures on the working valve, necessitating very high volume flow rates of the pneumatic fluid into and out of the cylinder in order to re-position and maintain the piston location and ultimately the working valve position. Furthermore, the high volumetric flow rates occur at extreme working pressures in the working valve that must be reacted by the piston. The prior art discloses several actuators or piston positioning systems adaptable for use in large scale applications.

One such prior art device includes an actuator system which modulates a linear output shaft associated with a working control valve in response to a control signal input. The system includes a feedback control link, a pneumatically controlled hydraulic valving system and a hydraulic cylinder and piston controlled by the hydraulic valving system. The hydraulic valving system includes a three-position, four-way valve actuated by pneumatic binary output signals from a signal conditioner which is in turn controlled by the positioner. Hydraulic flow to the three-position, four-way valve may also be controlled from the signal conditioner in response to positioner output for effective actuation of the hydraulic piston and cylinder assembly. Although the system exhibits rapid response time and high accuracy in positioning the piston within the cylinder, the system is necessarily complex and costly in that it combines hydraulic circuit components with pneumatic circuit components. Furthermore, the reference device suffers from various other limitations such as safety risks associated with the flammability of hydraulic fluid and the dangers of high pressure hydraulic fluid lines. Finally, such a device suffers from a high risk of leakage due to the large number of joints connecting the many components to the piping.

Another prior art device employs a rotary servo valve coupled to a torque motor in a pressurized fluid system for positioning a piston within a cylinder. The torque motor controls the flow of fluid within the system by rotating the servo valve, the servo valve comprising a spool element within a sleeve assembly and having fluid passageways. The flow of fluid is adjusted in order to position a piston within a cylinder. In the event of a power failure, an arrangement of torque rods, springs and other mechanical elements are required to center the servo valve and halt the flow of fluid within the system. Furthermore, the torque motor is inherently inaccurate in its ability to position the servo valve and therefore precisely position the piston within the cylinder because torque motors have no detent or zero position. Torque motors instead require a mechanical brake mechanism to stop their rotation at the desired location. This mechanical brake mechanism must also be constantly applied in order to firmly maintain the piston position when the motor is not turning. Consequently, the torque motor must always be energized or actuated throughout operation of the servo valve system. The servo system therefore requires large amounts of power while the force acting against the motor remains present.

As can be seen, there exists a need in the art for a piston positioning system which utilizes an inherently safe working fluid. Also, there exists a need in the art for a piston positioning system that is of simple construction, of low cost and requires low maintenance. In addition, there exists a need in the art for a piston positioning system that is compact such that travel time and compressibility of the working fluid within the system is minimized in order to reduce the "dead time on seat" of a working valve. Furthermore, there exists a need in the art for a piston positioning system that can precisely and quickly position a working valve under extreme operating pressures. Finally, there exists a need in the art for a piston positioning system that can be autonomously and quickly neutralized in the event of a power failure or loss of working fluid pressure.

SUMMARY OF THE INVENTION

The present invention specifically addresses and alleviates the above referenced deficiencies associated with pneumatic actuator circuits. More particularly, the present invention is an improved piston positioning system for positioning a piston within a cylinder of a pneumatic circuit. The piston positioning system includes a pneumatic valving device for manipulating a flow of pressurized pneumatic fluid within the pneumatic circuit. As will be demonstrated below, the piston positioning system of the present invention differs from piston positioning systems of the prior art in that it utilizes a pneumatic valving device for manipulating a flow of pressurized pneumatic fluid within the pneumatic circuit.

In accordance with the present invention, there is provided a piston positioning system for positioning a piston within a cylinder of a pneumatic circuit. The piston positioning system is comprised of a controller, a pneumatic valving device, and a solenoid valve for collectively manipulating a flow of pressurized pneumatic fluid (e.g., air) within the pneumatic circuit. The pneumatic valving device is comprised of a reversible stepper motor, a servo valve, a four-way valve and a two-way valve, all of which are advantageously integrated into a single unit. In this regard, the pneumatic valving device replaces the assorted components that are typically networked together with a maze of pneumatic lines in conventional pneumatic actuation systems. In the present invention, a piston is sealed within a cylinder having first and second ends. The pneumatic valving device is actuated by energization of the four-way valve and the two-way valve through pilot lines. Feed lines then carry the flow of pneumatic fluid through the servo valve and into either the first or second ends of the cylinder. The stepper motor incrementally rotates and shifts the servo valve axially to locate the servo valve at a prescribed position. The pneumatic valving device therefore moves the piston by regulating the stepper motor and servo valve. The regulation of the servo valve alternately forces pneumatic fluid into the first and second ends of the cylinder while simultaneously exhausting pneumatic fluid out of the respective second and first ends in order to extend and retract the piston along the length of the cylinder.

Importantly, the piston positioning system of the present invention includes a fail safe mode. In the fail safe mode of operation, the solenoid valve may be autonomously closed in the event of a loss of electrical power or a loss of pneumatic fluid pressure within the pneumatic circuit. The closing of the solenoid valve acts to de-energize the four-way valve and the two-way valve. The four-way valve is de-energized due to the mechanical biasing force of the spring overcoming the reduced pneumatic pressure at the pilot passage. The two-way valve is de-energized due to the pneumatic fluid pressure within the servo valve overcoming the reduced pneumatic pressure acting at the pilot port. The de-energized four-way valve then effectively isolates the servo valve such that the flow of pneumatic fluid through the servo valve is blocked. The flow of pneumatic fluid is directed back through the four-way valve and into the second end of the cylinder. The de-energized two-way valve simultaneously opens and allows remaining pneumatic fluid to escape the first end of the cylinder through the servo valve such that the piston retracts towards the second end.

BRIEF DESCRIPTION OF THE DRAWINGS

These as well as other features of the present invention will become more apparent upon reference to the drawings wherein.

Figure 1A:
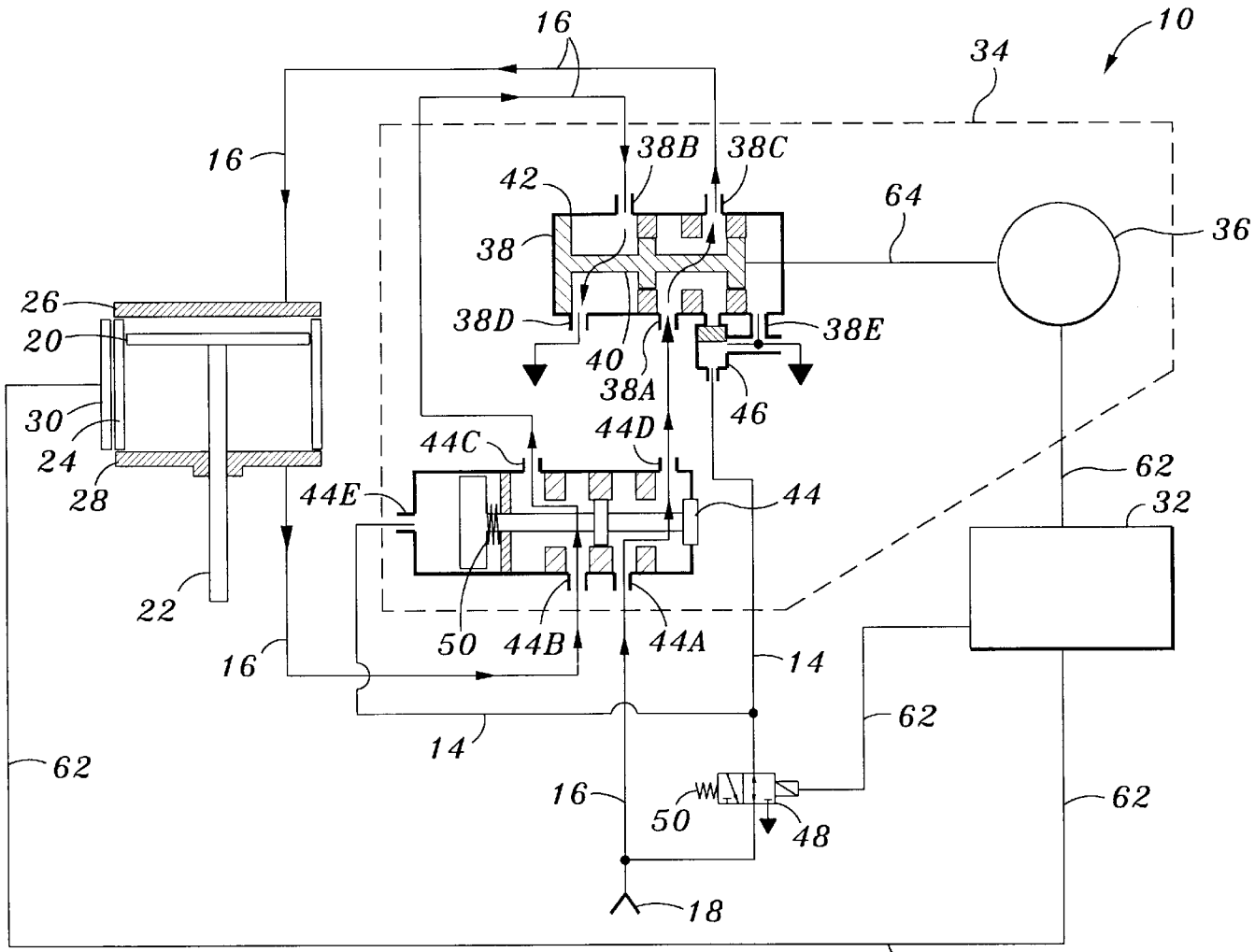
FIG. 1A is a schematic diagram of a pneumatic circuit of the present invention illustrating the positions of a solenoid valve, a four-way valve and a two-way valve and the flow directions of the pneumatic fluid when the pneumatic circuit is in a control mode and the piston is extended.

The drawing employs conventional graphic symbols for fluid power diagrams as specified in American National Standards Institute Y32.10.

DETAILED DESCRIPTION OF THE INVENTION

Figure 1B:
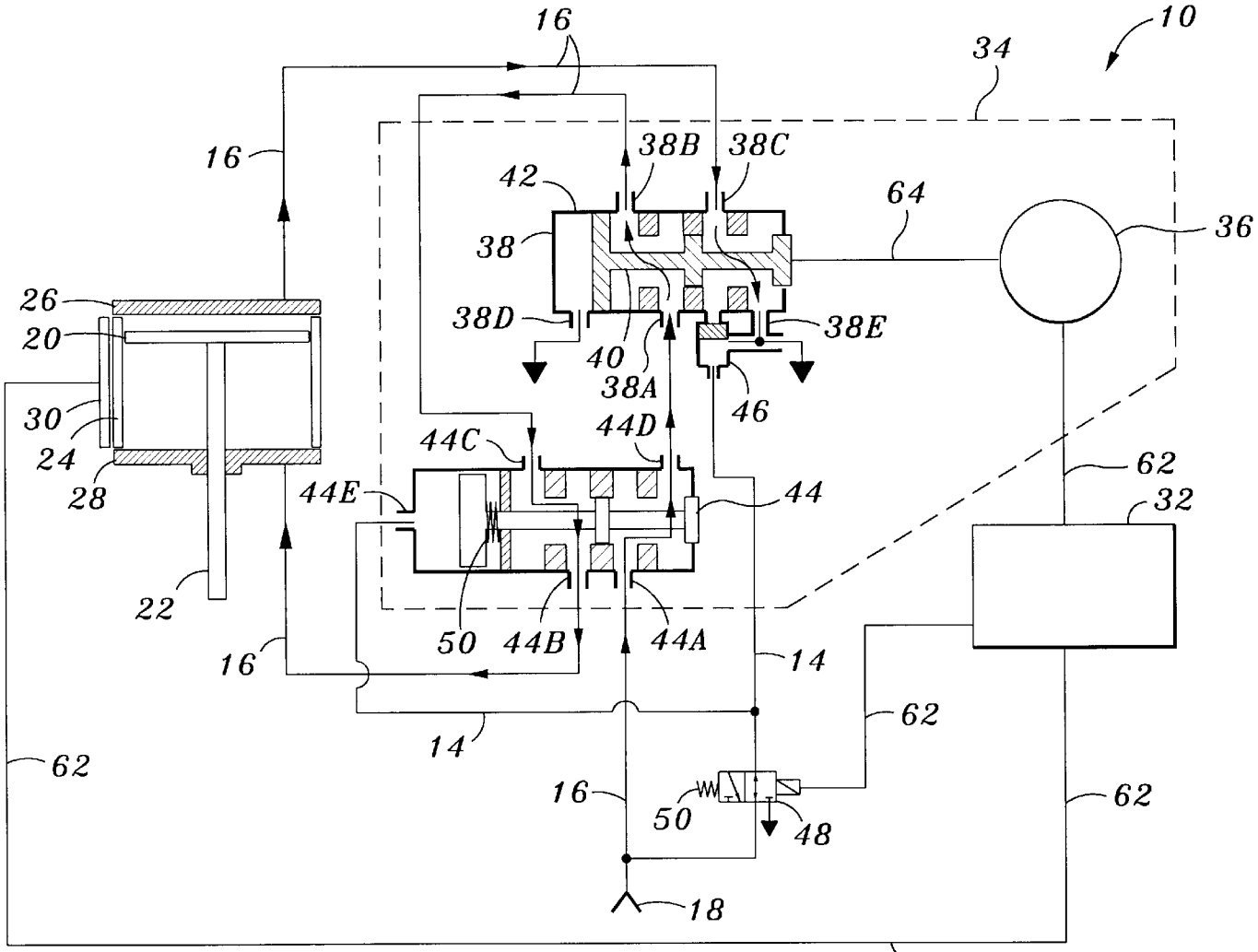
FIG. 1B is a schematic diagram of a pneumatic circuit of the present invention illustrating the positions of the solenoid valve, the four-way valve and the two-way valve and the flow directions of the pneumatic fluid when the pneumatic circuit is in a control mode and the piston is retracted.
Figure 3:
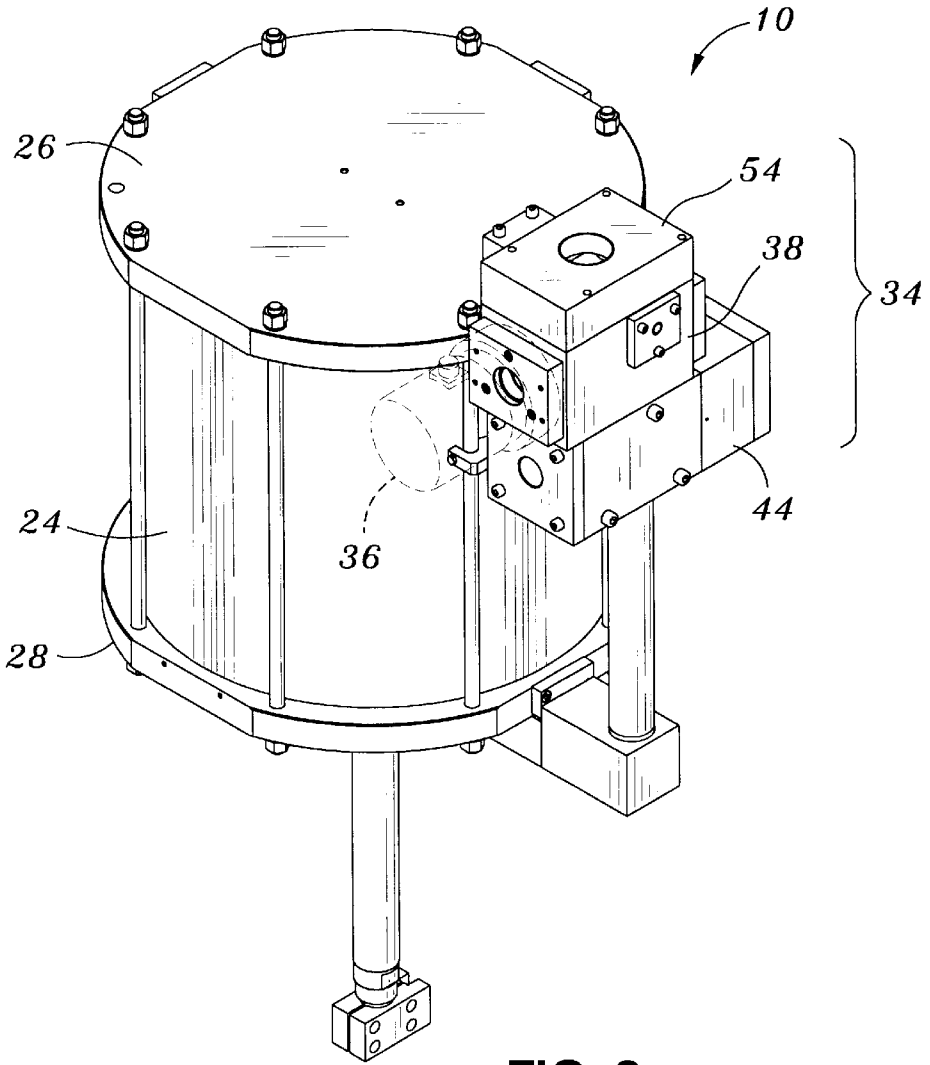
FIG. 3 is a perspective view of the piston positioning system of the present invention illustrating the interrelationship of a cylinder with a pneumatic valving device, the valving device incorporating the four-way valve, the two-way valve, a servo valve and a stepper motor therewithin.

Referring now to the drawings wherein the showings are for purposes of illustrating the present invention and not for purposes of limiting the same, FIGS. 1A and 1B are schematic diagrams of a pneumatic circuit of the present invention in the control mode of operation. As can be seen, the pneumatic circuit is comprised of a controller 32, a pneumatic valving device 34, and a solenoid valve 48 for collectively manipulating a flow of pressurized pneumatic fluid within the pneumatic circuit. The pneumatic valving device 34 is comprised of a reversible stepper motor 36, a servo valve 38, a four-way valve 44 and a two-way valve 46. The pneumatic fluid source 18 provides the pneumatic fluid, typically compressed air, to the pneumatic circuit. A piston 20 is slidably sealed within a cylinder 24, the cylinder 24 having first and second ends 26, 28. Control of the piston 20 is effected by regulating the flow of pneumatic fluid with the pneumatic valving device 34. FIG. 3 shows a perspective view of the piston positioning system 10 of the present invention illustrating the interrelationship of the cylinder 24 with the pneumatic valving device 34. The pneumatic valving device 34 is disposed adjacent the cylinder 24. As can be seen in FIG. 3, the servo and four-way valves 38, 44 are disposed adjacent each other.

Figure 8:
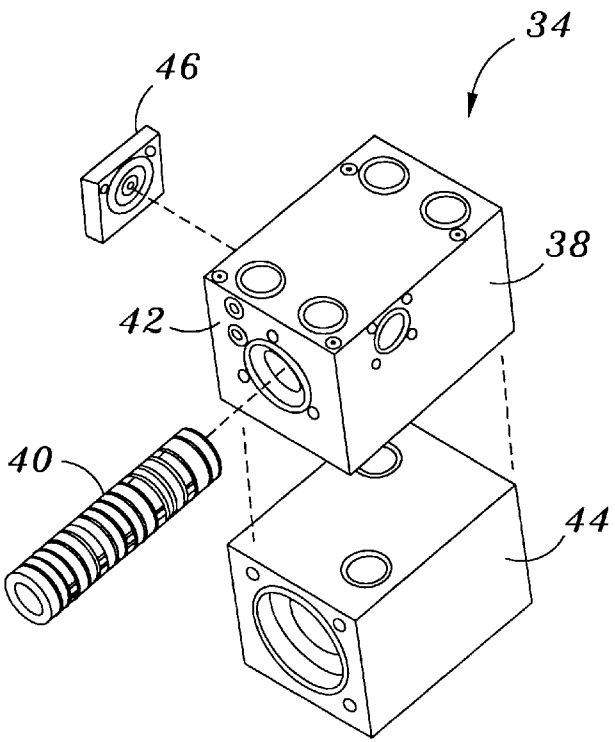
FIG. 8 is an exploded isometric view of the pneumatic valving device of the present invention.
Figure 5:
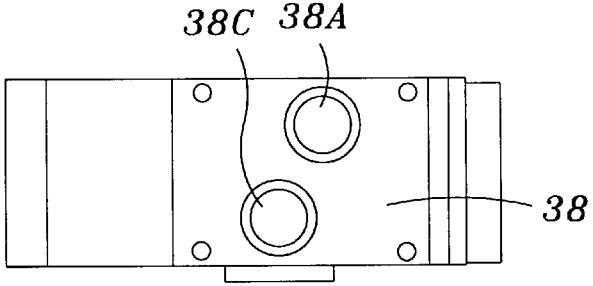
FIG. 5 is a top view taken along line 4—4 of the pneumatic valving device of FIG. 3 illustrating a supply port and a second control port of the servo valve.
Figure 6:
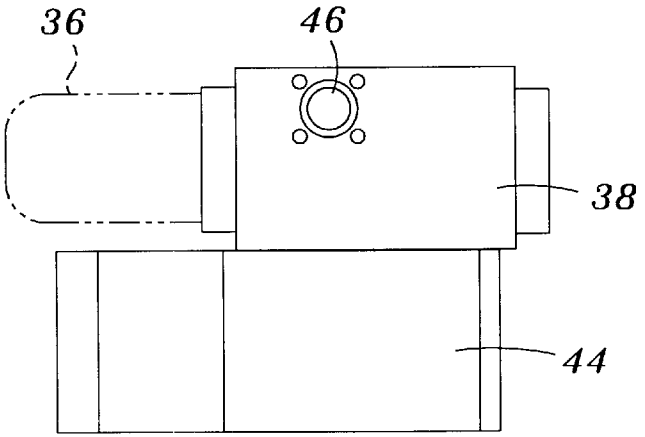
FIG. 6 is a side elevational view taken along line 6—6 of the pneumatic valving device of FIG. 5 illustrating the relationship of the servo valve with the four-way valve
Figure 7:
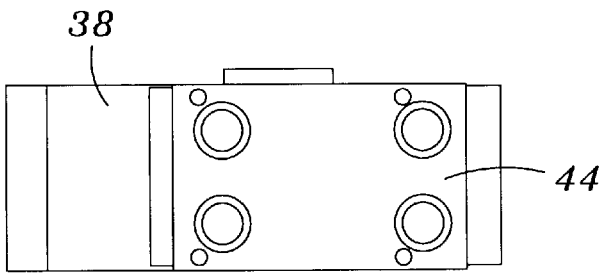
FIG. 7 is a bottom view taken along line 7—7 of the pneumatic valving device of FIG. 6 illustrating the four-way valve.

FIGS. 5, 6, 7 and 8 illustrate in more detail the components that make up the pneumatic valving device 34. FIG. 5 is a top view taken along line 4—4 of the pneumatic valving device 34 of FIG. 3 illustrating a supply port 38A and a second control port 38C of the servo valve 38. FIG. 6 is a side elevational view taken along line 6—6 of the pneumatic valving device 34 of FIG. 5 illustrating the relationship of the servo valve 38 with the four-way valve 44. FIG. 7 is a bottom view taken along line 7—7 of the pneumatic valving device 34 of FIG. 6 illustrating the four-way valve 44. FIG. 8 is an exploded isometric view of the pneumatic valving device 34. As will be explained in more detail below, the four-way valve 44, the stepper motor 36 and the servo valve 38 operate together to manipulate the flow of pneumatic fluid in the pneumatic circuit. The four-way valve 44 serves primarily to selectively block or unblock the flow of pneumatic fluid to the servo valve 38. The stepper motor 36 shifts the servo valve 38 axially to position the valve at a prescribed position. The servo valve 38 meters the flow of pneumatic fluid into and out of the cylinder 24 in response to the stepper motor 36.

As can be seen in FIG. 1A, the pneumatic valving device 34 may be actuated by energization of the four-way valve 44 and the two-way valve 46 through pilot lines 14. Feed lines 16, which are generally larger in diameter than pilot lines 14, then carry the flow of pneumatic fluid through the servo valve 38 and into either the first end 26 or second end 28 of the cylinder 24. The piston 20 may have a shaft 22 extending out of the cylinder 24 and connected to the component to be moved. The pneumatic system moves the piston 20 by forcing pneumatic fluid into the first end 26 of the cylinder 24 while simultaneously exhausting pneumatic fluid out of the second end 28 of the cylinder 24 in order to advance the piston 20 along the length of the cylinder 24 as shown in FIG. 1A. Conversely, the pneumatic system may force pneumatic fluid into the second end 28 of the cylinder 24 while simultaneously exhausting pneumatic fluid out of the first end 26 of the cylinder 24 in order to retract the piston 20 in the opposite direction as shown in FIG. 1B. By driving the pneumatic fluid into alternate ends of the cylinder 24, the piston 20 is moved such that the shaft 22 can be displaced in any position.

Figure 4:
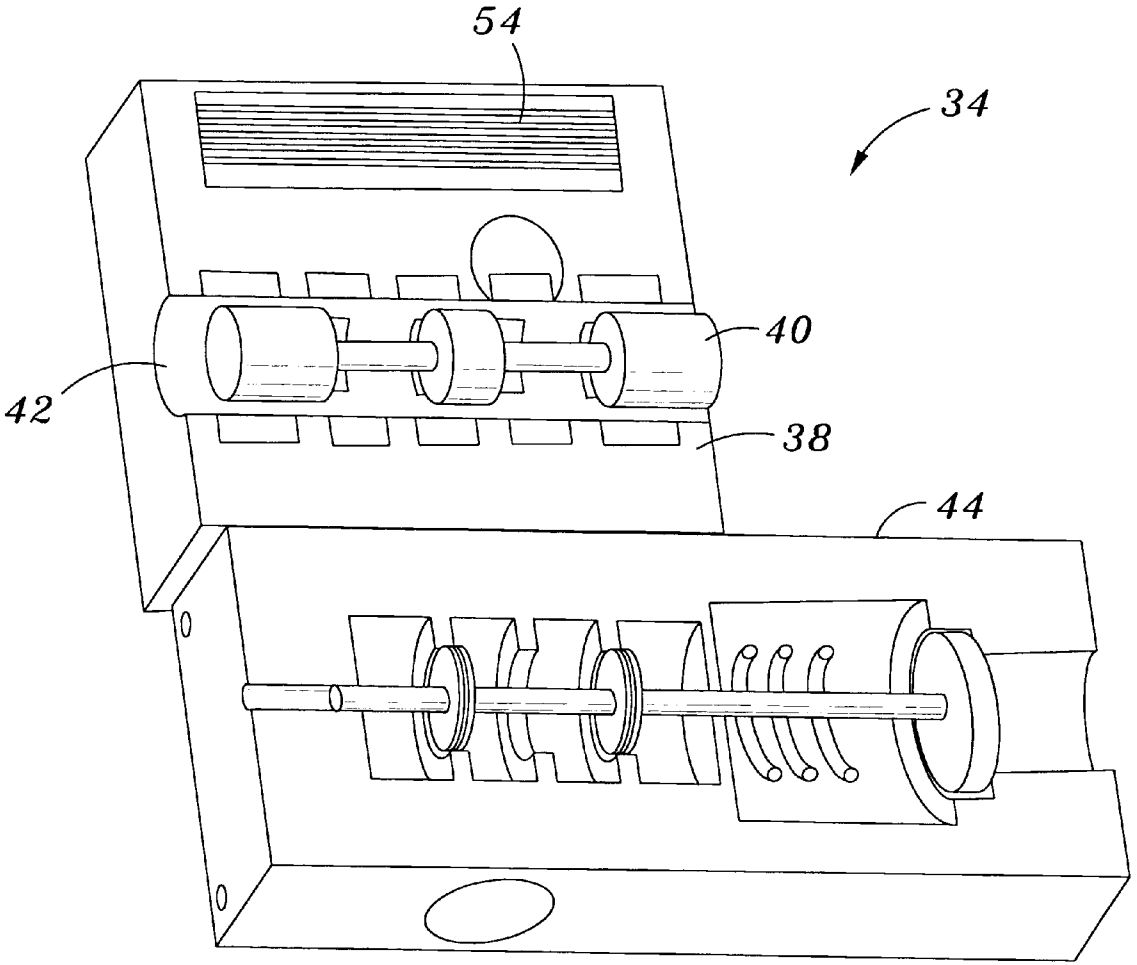
FIG. 4 is a cutaway perspective view of the pneumatic valving device of the present invention illustrating the four-way valve, the two-way valve and the servo valve.

In FIG. 1A, shown is a schematic diagram of a pneumatic circuit of the present invention illustrating the positions of the solenoid valve 48, the four-way valve 44 and the two-way valve 46 and the flow directions of the pneumatic fluid when the pneumatic circuit is in a control mode and the piston 20 is extended. FIG. 1B is a schematic diagram of a pneumatic circuit of the present invention illustrating the positions of the solenoid valve 48, the four-way valve 44 and the two-way valve 46 and the flow directions of the pneumatic fluid when the pneumatic circuit is in a control mode and the piston 20 is retracted. Also included in the pneumatic circuit are the controller 32 and the stepper motor 36. As mentioned above, the pneumatic valving device 34 of the present invention combines the stepper motor 36, the servo valve 38, the four-way valve 44 and the two-way valve 46 into an integrated unit, as shown in FIG. 4. The four-way valve 44 is a two-position, four-way, pneumatically controlled, spring-centered valve. A spring 50 biases the four-way valve 44 to a normally "closed" position, wherein flow to the servo valve 38 is isolated. Although shown in FIG. 1A as having a mechanical biasing spring 50, it is contemplated that other biasing means may be utilized with the four-way valve 44 for biasing in the normally "closed" position. The four-way valve 44 has a pilot passage 44E, a supply passage 44A, first and second control passages 44B, 44C, and an outlet passage 44D. The pilot passage 44E is fluidly connected to the solenoid valve 48 through a pilot line 14.

When the solenoid valve 48 is toggled to the open position by the controller 32, the four-way valve 44 is energized, allowing pneumatic fluid to flow into the supply passage 44A, through the first and second control passages 44B, 44C in either direction, and out of four-way valve 44 through the outlet passage 44D. The supply passage 44A is fluidly connected to the pneumatic fluid source 18 through a feed line 16. The first control passage 44B fluidly connects the four-way valve 44 to the second end 28 of the cylinder 24 through a feed line 16. The second control passage 44C is fluidly connected to the servo valve 38 through a feed line 16 to allow the pneumatic fluid to flow between the servo valve 38 and the four way valve. The outlet passage 44D is fluidly connected to the servo valve 38 such that when the four-way valve 44 is energized, the four-way valve 44 shifts axially allowing pneumatic fluid to flow into the supply passage 44A, through the four-way valve 44 and out of the outlet passage 44D towards the servo valve 38. When not energized, the pneumatic fluid flows into the supply passage 44A, through the four-way valve 44 and out of the first control passage 44B through a feed line 16 to the second end 28 of the cylinder 24.

The pneumatic valving device 34 includes the linearly translatable, variable position servo valve 38. The servo valve 38 includes a spool 40 axially slidably sealed within a servo valve housing 42, as can be seen in FIG. 4. The servo valve 38 has a supply port 38A, first and second control ports 38B, 38C, and first and second exhaust ports 38D, 38E. The supply port 38A of the servo valve 38 is fluidly connected to the outlet passage 44D of the four-way valve 44. The first control port 38B of the servo valve 38 is fluidly connected to the second control passage 44C of the four-way valve 44 to allow pneumatic fluid to flow therebetween. The second control port 38C is fluidly connected to the first end 26 of the cylinder 24 to allow pneumatic fluid to flow therebetween. The first exhaust port 38D provides a vent path for pneumatic fluid flowing into the servo valve 38 from the first control port 38B. The first exhaust port 38D selectively vents the pressurized pneumatic fluid to an area of lower pressure, such as to the atmosphere, depending on the position of the spool 40 within the servo valve housing 42 as shown in FIGS. 1A and 1B. The second exhaust port 38E provides a vent path for pneumatic fluid flowing into the servo valve 38 from the second control port 38C. The second exhaust port 38E also vents the pneumatic fluid to an area of lower pressure.

As will be explained in more detail below, the spool 40 is shuttled back and forth within the housing to alternately allow pneumatic fluid to flow into the supply port 38A, through the first and second control ports 38B, 38C in either direction, and out of first and second exhaust ports 38D, 38E. Pneumatic fluid may flow into and out of the first and second control ports 38B, 38C and into alternate first and second ends 26, 28 of the cylinder 24 to control the position of the piston 20. Rather than acting as an "on/off" valve, the servo valve 38 utilized in the present invention is a variable flow valve. The servo valve 38 meters the flow of pneumatic fluid into and out of the cylinder 24. Acceleration and deceleration of the piston 20 is accomplished by varying the position of the spool 40 within the housing at a controlled rate of speed in order to adjust the flow rate. The spool 40 is used to regulate the size of the port orifices which in turn controls the flow rate of pneumatic fluid to the cylinder 24. By varying the orifice size, the flow of pneumatic fluid through the servo valve 38 can be regulated throughout the full range from minimal flow up to maximum rated flow.

As can be seen in FIG. 1A, the pneumatic valving device 34 also includes a two-way valve 46 which, unlike the servo valve 38, is an "on/off" valve. The two-way valve 46 has a pilot port 46A fluidly connected to the solenoid valve 48. The two way valve 46 is mounted on the servo valve 38 of the pneumatic valving device 34 and may be biased into the open position whenever the pressure of pneumatic fluid within the servo valve 38 is greater than that acting on the pilot port 46A. The two-way valve 46 is selectively operative to block the exhaust of pneumatic fluid out of the servo valve 38 such that the pneumatic fluid may be driven into the first end 26 when the two-way valve 46 is energized to the closed position. When the two-way valve 46 is not energized into the closed position, the pneumatic fluid may flow out of the servo valve 38 through the two way valve and out of the second exhaust port 38E or, alternately, out of the second exhaust port 38E alone, depending on the axial position of the spool 40. In this manner, the two-way valve 46 acts as a fail safe mechanism for the pneumatic circuit such that the piston 20 may be retracted upon either a loss of electrical power or pneumatic pressure, as will be explained in more detail below.

In the pneumatic valving device 34 of the present invention, also included is the stepper motor 36. The reversible stepper motor 36 is mechanically coupled to the servo valve 38 via a mechanical linkage. The stepper motor 36 is also electrically connected to the controller 32 and is incrementally rotatable over a desired angle of rotation. The stepper motor 36 is responsive to electrical pulses that may be emitted by the controller 32 for controlling the servo valve 38 so as to regulate the pneumatic fluid flowing therethrough. The configuration of the stepper motor 36 may be such that it may be may positioned to within +\–3 arc-minutes, allowing for precise, bi-directional, linear incremental movement and accurate positioning of the spool 40 within the servo valve housing 42. In this regard, the servo valve 38 is operatively responsive to the incremental rotation of the stepper motor 36 such that the flow of pneumatic fluid may be alternately directed into the first and second ends 26, 28 of the cylinder 24 for respectively retracting and extending the piston 20.

It is contemplated that the pneumatic valving device 34 may include a muffler 54 fluidly connected to the servo valve 38 for reducing the noise level of pneumatic fluid that is exhausted out of the servo valve 38. As is seen in FIG. 4, the muffler 54 may be disposed adjacent the first and second exhaust ports 38D, 38E of the servo valve 38 such that pneumatic fluid exiting the first and second exhaust ports 38D, 38E must pass through the muffler 54 prior to venting into the atmosphere. Although the muffler 54 may be configured in any shape or size and may be formed of any material, it is contemplated that the muffler 54 may include a stack of plates, each plate having a plurality of holes. The holes in adjacent plates may be arranged such that when stacked together, the plates define tortuous flow paths for the exhausting pneumatic fluid. The tortuous flow paths may effect a reduction in flow velocity such that the pressure of the pneumatic fluid as it escapes the muffler 54 into the atmosphere is reduced, thus lowering the noise level.

Turning back now to FIG. 1A, included in the pneumatic circuit is a controller 32 in electrical communication with the piston position indicator 30 and the stepper motor 36. The controller 32 may be electrically powered and may receive command signals indicative of a desired position of the piston 20. The controller 32 also receives signals indicative of the position of the piston 20 from a piston position indicator 30. The piston position indicator 30 may be disposed adjacent the cylinder 24. The piston position indicator 30 senses an actual position of the piston 20 within the cylinder 24 and generates a piston position signal in response thereto. The piston position indicator 30 may be comprised of pickup magnets (not shown) mounted on the piston 20. A feedback transducer (also not shown) may be mounted on the cylinder 24, the feedback transducer being electrically connected to the controller 32 such that piston position signals may be relayed to the controller 32. Regardless of the manner in which the position of the piston 20 is relayed to the controller 32, the controller 32 generates an output signal representative of a desired movement of the piston 20 based on the difference in magnitude between the piston position signal and the command signal. The output signal is relayed to the stepper motor 36 in the form of electrical pulses which in turn effect incremental rotation of the stepper motor 36 in proportion to the magnitude of the output signal.

FIG. 1A also illustrates a solenoid valve 48 included in the pneumatic circuit. The solenoid valve 48 is fluidly connected to and interposed between the pneumatic fluid source 18 and the two-way and four-way valves 46, 44 at the respective pilot port 46A and pilot passage 44E via pilot lines 14. The solenoid valve 48 is also electrically connected to the controller 32 via an electrical line 62. The solenoid valve 48 is a two-position, three-way, electrically controlled, spring centered valve. A spring 50 biases the solenoid valve 48 to a closed position. Although shown in FIG. 1A as having a mechanical biasing spring 50, it is contemplated that other biasing means may be utilized with the solenoid valve 48 for biasing to the closed position. The solenoid valve 48 is configured to open in response to the controller 32 such that pneumatic fluid may flow into the pneumatic circuit. When initiated by the controller 32, the solenoid overcomes the biasing force of the spring 50 to toggle the solenoid valve 48 to the open position. In the open position as shown in FIG. 1A, pneumatic fluid may flow from the pneumatic fluid source 18 to the pilot passage 44E and the pilot port 46A such that the respective four-way and two-way valves 44, 46 may be energized. The four-way valve 44 and the two-way valve 46 then overcome the respective biasing force provided by the spring 50 in the four-way valve 44 and the ambient pressure in the servo valve 38. The four-way valve 44 and two-way valve 46 are then driven to their respective open and closed positions.

Figure 2:
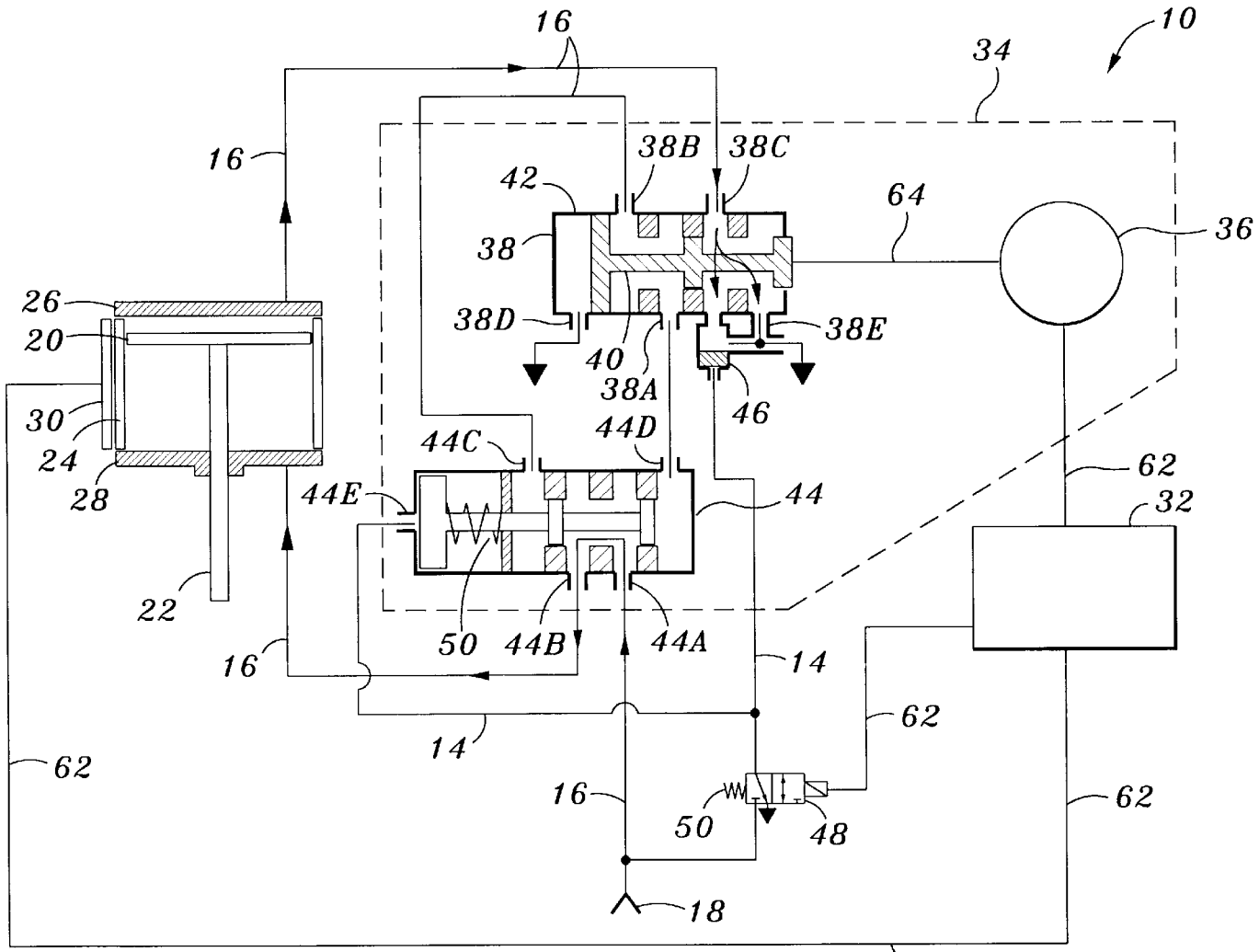
FIG. 2 is a schematic diagram of the pneumatic circuit of the present invention illustrating the positions of the solenoid valve, the four-way valve and the two-way valve when the pneumatic circuit is in a fail safe mode.

Turning briefly now to FIG. 2, shown is a schematic diagram of the pneumatic circuit of the present invention illustrating the positions of the solenoid valve 48, the four-way valve 44 and the two-way valve 46 when the pneumatic circuit is in a fail safe mode. In order to neutralize the pneumatic circuit , the solenoid valve 48 is configured to de-energize the four-way valve 44 and the two-way valve 46 upon a loss of electrical power or upon a loss of pneumatic fluid pressure. In either scenario, the solenoid valve 48 will shift back to its original closed position due to the biasing force of the spring 50. When this occurs, the two-way valve 46 and four-way valve 44 will be de-energized. The de-energized four-way valve 44 will shift back to its initial position such that the servo valve 38 is isolated from flow of pneumatic fluid from the four-way valve 44. The flow of pneumatic fluid is shunted back through the four-way valve 44 out of the first control passage 44B and into the second end 28. The de-energized two-way valve 46 also shifts back to its de-energized position and simultaneously allows pneumatic fluid to escape the first end 26 through the servo valve 38 regardless of the position of the spool 40 within the servo valve housing 42 such that the piston 20 may retract towards the first end 26. If the shaft 22 of the piston 20 were, for example, connected to a working valve mounted on a pipe carrying superheated steam, then upon a loss of electrical power or pneumatic fluid pressure, the retracting shaft 22 would cause the valve to shift to an open position. Such a scenario may be desirable if the working valve were a desuperheating spray nozzle for spraying cooling water into a flow of superheated steam to prevent the superheated steam from damaging downstream components.

However, it is contemplated that the pneumatic valving device 34 may be "flipped" or arranged within the pneumatic circuit wherein the four-way valve 44 is fluidly connected to the first end 26 and the servo valve 38 is fluidly connected to the second end 28. In such a configuration, the two-way valve 46 is operative to block the flow of pneumatic fluid through the servo valve 38 such that the pneumatic fluid may be driven into the first end 26 when the two-way valve 46 and four-way valve 44 are de-energized such that the piston 20 may extend toward the second end 28. Using the example above wherein the shaft 22 is connected to a desuperheating spray nozzle for spraying cooling water, the spray nozzle would tend to close as the shaft 22 extends towards the second end 28, shutting off the flow of cooling water spray into the flow of superheated steam when the pneumatic circuit is in the fail safe mode.

A filter regulator (not shown) may optionally be included in the pneumatic circuit , the filter regulator fluidly communicating with the source of pneumatic fluid and the four-way valve 44 through the feed line 16. The pneumatic fluid is typically provided at a much higher pressurization level than can be utilized by the pneumatic circuit. For example, the pneumatic fluid may be pressurized at up to 1000 psi. Because standard pneumatic circuits are designed to operate at a much lower level, the filter regulator reduces the pressurization level of the pneumatic fluid to a safe working level. The filter regulator of the pneumatic circuit of the present invention may be preset to a maximum of 150 psi. The filter regulator also filters the pneumatic fluid to remove contaminates, oil and water-vapor that may harm downstream components. It is contemplated that the pneumatic circuit may include only a regulator. Alternately, the pneumatic circuit may include only a filter if the pneumatic fluid is conditioned to a reduced working pressure prior to entry into the pneumatic circuit.

Also includable in the pneumatic circuit is an optional reservoir tank or volume tank (not shown). The volume tank may be disposed between and in fluid communication with the pneumatic fluid source 18 and the four-way valve 44. Because a filter regulator (not shown), if included in the pneumatic circuit, can only supply compressed air at a limited flow rate, the volume tank may be added downstream of such regulator. A volume tank check valve (not shown) may also be installed between the volume tank and the filter regulator or pneumatic fluid source 18. The volume tank check valve may be oriented to block the flow of compressed air from the volume tank to the filter regulator while allowing flow in the opposite direction. The volume tank may be filled by the filter regulator with pneumatic fluid which may be held at the pressure set by the filter regulator. In the case of a loss of pneumatic pressure, the pressurized pneumatic fluid in the volume tank would aid in quickly retracting or extending the piston 20, depending on the orientation of the pneumatic valving device 34 within the pneumatic circuit.

It is further contemplated that adjustable restrictions (not shown) may be included within the pneumatic circuit. The adjustable restrictions may comprise needle valves that may be installed in the pilot lines 14 between the pilot passage 44E and the solenoid valve 48 as well as between the pilot port 46A and the solenoid valve 48. In this regard, the adjustable restrictions may provide sensitivity adjustment for the four-way and two-way valves 44, 46 such that the point at which the four-way and two-way valves 44, 46 may be pneumatically energized may be regulated.

The operation of the piston positioning system 10 will now be discussed. In the control mode of operation shown in FIG. 1, the piston 20 is positioned within the cylinder 24 by the collective manipulation of pressurized pneumatic fluid with the controller 32, the solenoid valve 48, the stepper motor 36, the servo valve 38, the four-way valve 44 and the two-way valve 46. The solenoid valve 48 is opened upon initiation by the controller 32. The opened solenoid energizes the four-way valve 44 and the two-way valve 46. The energized four-way valve 44 allows the pneumatic fluid to flow between the energized four-way valve 44 and the servo valve 38. The energized two-way valve 46 blocks the flow of pneumatic fluid out of the two-way valve 46 such that the flow thereof may be driven into the first end 26 of the cylinder 24 in order to extend the piston 20 toward the second end 28.

During normal operation, the piston position indicator 30 senses an actual position of the piston 20 within the cylinder 24. A piston position signal representative of the actual position of the piston 20 is then generated and is relayed to the controller 32 via an electrical line 62. The controller 32 then compares the piston position signal to a command signal representative of a desired position of the piston 20. The controller 32 then generates an output signal representative of the difference in magnitude between the piston position signal and the command signal. It is contemplated that the controller 32 may be configured to continuously record the command signal to create a time history thereof. The time history may be used to determine a rate of change of the command signal. The command signal rate of change may be used in the output signal such that the output signal represents a combination of the command signal rate of change and the difference in magnitude between the piston position signal and the command signal. In this regard, the incremental rotation of the stepper motor 36 is in proportion to both the magnitude of the output signal and the command signal rate of change.

The output signal is relayed to the stepper motor 36 such that the stepper motor 36 may be incrementally rotated over a desired angle of rotation in proportion to the magnitude of the output signal in order to effect a proportional incremental linear translation of the servo valve 38. If the command signal rate of change is included in the output signal, then as mentioned above, the incremental rotation of the stepper motor 36 is in proportion to both the magnitude of the output signal and the command signal rate of change. The servo valve 38 is linearly translated in response to the incremental rotation of the stepper motor 36 such that the flow of pneumatic fluid may be proportionally adjusted through the servo valve 38. The piston 20 is alternately retracted and extended towards the respective first and second ends 26, 28 of the cylinder 24 in response to the adjustment of pneumatic fluid flow through the servo valve 38 in such a manner as to correct for the difference between the desired position of the piston 20 and the actual position of the piston 20. In this regard, the servo valve 38 is operative to allow pneumatic fluid to flow therethrough and into the second end 28 while allowing pneumatic fluid to escape the first end 26 through the servo valve 38 such that the piston 20 is retracted, as illustrated in FIG. 1B. Alternately, the servo valve 38 may allow pneumatic fluid to flow therethrough and into the first end 26 while allowing pneumatic fluid to escape the second end 28 through the servo valve 38 such that the piston 20 is extended, as illustrated in FIG. 1A.

In the fail safe mode of operation indicated in FIG. 2, the solenoid valve 48 is autonomously closed upon the attainment of at least one of two preset conditions, including a loss of electrical power or a loss of pneumatic fluid pressure within the pneumatic circuit. The closing of the solenoid valve 48 acts to de-energize the four-way valve 44 and the two-way valve 46. The four-way valve 44 is de-energized due to the mechanical biasing force of the spring 50 overcoming the pneumatic pressure at the pilot passage 44E. The two-way valve 46 is de-energized due to the pneumatic fluid pressure within the servo valve 38 overcoming the pneumatic pressure acting at the pilot port 46A. The de-energized four-way valve 44 then effectively isolates the servo valve 38 such that the flow of pneumatic fluid therebetween is blocked while shunting the flow of pneumatic fluid back through the four-way valve 44 and into the second end 28 of the cylinder 24. The de-energized two-way valve 46 simultaneously allows pneumatic fluid to escape the first end 26 through the servo valve 38 regardless of the position of the spool 40 such that the piston 20 retracts towards the second end 28. Alternately, in configurations wherein the pneumatic valving device 34 is "flipped" such that the four-way valve 44 is fluidly connected to the first end 26 and the servo valve 38 is fluidly connected to the second end 28 of the cylinder 24, in the event of a loss of either electrical power or pneumatic fluid pressure, the flow is shunted back through the four-way valve 44 into the first end 26. The de-energized two-way valve 46 simultaneously allows pneumatic fluid to escape the second end 28 through the servo valve 38 such that the piston 20 extends toward the first end 26.

In a failure scenario involving a loss of pneumatic fluid, the activation of the fail safe condition is predicated upon the configuration of the four-way and two-way valves 44, 46 as being pneumatically energizable. In a scenario involving a loss of electrical power, the activation of the fail safe condition is predicated upon the configuration of the stepper motor 36 and the solenoid valve 48 as being electrically powered, and wherein the position of the piston 20 and output signals are electrically relayed.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A method for positioning a piston within a cylinder of a pneumatic circuit, the cylinder having first and second ends and a piston position indicator, the pneumatic circuit having a controller, a reversible stepper motor, a servo valve, a four-way valve, a two-way valve, and a solenoid valve for collectively manipulating a flow of pressurized pneumatic fluid within the pneumatic circuit, the method comprising the steps of:

a. opening the solenoid valve to energize the four-way valve and the two-way valve, the energized four-way valve allowing the pneumatic fluid to flow between the energized four-way valve and the servo valve, the energized two-way valve blocking the flow of pneumatic fluid therethrough such that the flow thereof may be driven into the first end;

b. sensing an actual piston position within the cylinder with the piston position indicator;

c. generating a piston position signal representative of the actual piston position;

d. relaying the piston position signal to the controller;

e. comparing the piston position signal to a command signal representative of a desired piston position;

f. generating an output signal representative of the difference in magnitude between the piston position signal and the command signal;

g. relaying the output signal to the stepper motor;

h. incrementally rotating the stepper motor over a desired angle of rotation in proportion to the magnitude of the output signal in order to effect a proportional incremental linear translation of the servo valve;

i. translating the servo valve in response to the incremental rotation of the stepper motor such that the flow of pneumatic fluid may be proportionally adjusted through the servo valve; and j. alternately retracting and extending the piston towards the respective first and second ends of the cylinder in response to the adjustment of pneumatic fluid flow through the servo valve in such a manner as to correct for the difference between the desired piston position and the actual piston position.

2. The method of claim 1 further comprising the step of:

k. selectively closing the solenoid valve in order to de-energize the four-way valve and the two-way valve upon attainment of a preset condition, the de-energized four-way valve being effective to isolate the servo valve such that the flow of pneumatic fluid therebetween is blocked while shunting the flow of pneumatic fluid back through the four-way valve and into the second end, the de-energized two-way valve simultaneously allowing pneumatic fluid to escape the first end through the servo valve regardless of the position thereof such that the piston retracts towards the second end.

3. The method of claim 2 wherein the flow is shunted back through the four-way valve into the first end and the de-energized two-way valve simultaneously allows pneumatic fluid to escape the second end through the servo valve such that the piston extends toward the first end.

4. The method of claim 2 wherein the four-way and two-way valves are pneumatically energized and the preset condition includes a loss of pneumatic fluid pressure.

5. The method of claim 2 wherein the piston position signal and output signal are electrically relayed, the stepper motor and the solenoid valve are electrically powered, and the preset condition includes a loss of electrical power.

6. The method of claim 1 wherein the servo valve is selectively operative to allow pneumatic fluid to flow therethrough and into the second end while allowing pneumatic fluid to escape the first end through the servo valve such that the piston is retracted.

7. The method of claim 1 wherein the servo valve is selectively operative to allow pneumatic fluid to flow therethrough and into the first end while allowing pneumatic fluid to escape the second end through the servo valve such that the piston is extended.

8. A piston positioning system for positioning a piston within a cylinder of a pneumatic circuit, the system manipulating a flow of pneumatic fluid such that the position of the piston may be adjusted, the cylinder having first and second ends, the system comprising:

a pneumatic fluid source for providing pressurized pneumatic fluid to the pneumatic circuit;

a piston position indicator mounted adjacent the cylinder for sensing an actual piston position within the cylinder and generating a piston position signal in response thereto;

a controller in electrical communication with the piston position indicator for generating an output signal in response to the piston position signal, the output signal being representative of a desired piston movement;

a solenoid valve electrically connected to the controller and fluidly connected to the pneumatic fluid source, the solenoid valve configured to open in response to the controller such that pneumatic fluid may flow into the pneumatic circuit; and a pneumatic valving device comprising:

a four-way valve fluidly connected to the second end and to the pneumatic fluid source for allowing flow therethrough when energized by the solenoid valve;

a reversible stepper motor electrically connected to the controller and incrementally rotatable over a desired angle of rotation in proportion to the magnitude of the output signal;

a linearly translatable servo valve mechanically coupled to the stepper motor and fluidly connected to the four-way valve and the first end, the servo valve being responsive to the incremental rotation of the stepper motor such that the flow of pneumatic fluid may be alternately directed into the first and second ends of the cylinder for respectively retracting and extending the piston; and a two-way valve fluidly connected to the solenoid valve and the servo valve, the two-way valve being selectively operative to block the exhaust of pneumatic fluid out of the servo valve such that the pneumatic fluid may be driven into the first end when the two-way valve is energized to the closed position.

9. The piston positioning system of claim 8 wherein the solenoid valve is configured to de-energize the four-way valve and the two-way valve upon a loss of electrical power, the de-energized four-way valve being effective to isolate the servo valve such that the flow of pneumatic fluid therebetween is blocked while shunting the flow of pneumatic fluid back through the four-way valve and into the second end, the de-energized two-way valve simultaneously allowing pneumatic fluid to escape the first end through the servo valve regardless of the position thereof such that the piston may retract toward the first end.

10. The piston positioning system of claim 8 wherein the four-way valve is fluidly connected to the first end, the servo valve is fluidly connected to the second end, and the two-way valve is operative to block the flow of pneumatic fluid through the servo valve such that the pneumatic fluid may be driven into the first end when the two-way and four-way valves are de-energized such that the piston may extend toward the second end.

11. The piston positioning system of claim 8 further comprising a muffler fluidly connected to the servo valve for reducing the noise level of pneumatic fluid that is exhausted out of the servo valve.

* * * * *